US008695319B2

(12) United States Patent
Zhu

(10) Patent No.: US 8,695,319 B2
(45) Date of Patent: Apr. 15, 2014

(54) YARNS OF POLYOXADIAZOLE AND MODACRYLIC FIBERS AND FABRICS AND GARMENTS MADE THEREFROM AND METHODS FOR MAKING SAME

(75) Inventor: Reiyao Zhu, Moseley, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 4 days.

(21) Appl. No.: 13/311,133

(22) Filed: Dec. 5, 2011

(65) Prior Publication Data

US 2013/0139306 A1 Jun. 6, 2013

(51) Int. Cl.
*D02G 3/04* (2006.01)

(52) U.S. Cl.
USPC ..... 57/255

(58) Field of Classification Search
USPC ..... 57/252, 255
See application file for complete search history.

(56) References Cited

U.S. PATENT DOCUMENTS

| | | | | |
|---|---|---|---|---|
| 3,193,602 | A | 7/1965 | Leonard et al. | |
| 3,748,302 | A | 7/1973 | Jones | |
| 4,091,159 | A * | 5/1978 | Brydon et al. | 428/394 |
| 4,202,962 | A | 5/1980 | Bach | |
| 5,208,105 | A | 5/1993 | Ichibori et al. | |
| 5,506,042 | A | 4/1996 | Ichibori et al. | |
| 2008/0153373 | A1 * | 6/2008 | Hall et al. | 442/148 |
| 2009/0053951 | A1 * | 2/2009 | Zhu et al. | 442/189 |
| 2009/0053955 | A1 * | 2/2009 | Zhu et al. | 442/302 |
| 2009/0053956 | A1 * | 2/2009 | Zhu et al. | 442/302 |
| 2009/0053957 | A1 * | 2/2009 | Zhu et al. | 442/302 |
| 2009/0188024 | A1 * | 7/2009 | Zhu et al. | 2/455 |
| 2013/0055490 | A1 * | 3/2013 | Zhu | 2/458 |

FOREIGN PATENT DOCUMENTS

WO WO 00/77283 A2 12/2000

OTHER PUBLICATIONS

John Wiley & Sons; Encyclopedia of Polymer Science and Engineering, vol. 12; pp. 322-339, 1988.

* cited by examiner

*Primary Examiner* — Shaun R Hurley

(57) ABSTRACT

This invention relates to a flame-resistant spun yarn, woven fabric, and protective garment, comprising a blend of 60 to 85 parts by weight of polyoxadiazole staple fiber and 15 to 40 parts by weight modacrylic staple fiber; based on 100 total parts of the polyoxadiazole staple fiber and modacrylic staple fiber in the yarn. This invention also relates to methods for making the yarn.

14 Claims, No Drawings

YARNS OF POLYOXADIAZOLE AND MODACRYLIC FIBERS AND FABRICS AND GARMENTS MADE THEREFROM AND METHODS FOR MAKING SAME

BACKGROUND OF INVENTION

1. Field of the Invention

The invention relates to a flame-resistant spun staple yarns, and fabrics and garments comprising these yarns, and methods of making the same. The yarns have 60 to 85 parts by weight of polyoxadiazole staple fiber and 15 to 40 parts by weight modacrylic staple fiber; based on the total amount of the polyoxadiazole staple fiber and modacrylic staple fiber in the yarn.

2. Background of the Invention

Industrial workers and others that can be exposed to flames, high temperatures, and/or electrical arcs and the like, need protective clothing and articles made from thermally resistant fabrics. Any increase in the effectiveness of these protective articles, or any increase in the comfort or durability of these articles while maintaining protection performance, is welcomed.

Fabrics made from 100% polyoxadiazole fiber generally are deemed to have good thermal resistance because such fabrics, when tested, have a limiting oxygen index in excess of 21, meaning that they will not sustain a flame in air. Further, freshly made 100% polyoxadiazole fiber fabrics can have an acceptable char length, which is 4 inches or less, when determined in accordance with ASTM D-6413-99 "Standard Test Method for Flame Resistance of Textiles (Vertical Method)", also known as the "Vertical Flame Test". Such fabrics are used in clothing that is repeatedly exposed to a cycle of wearing and washing, and it has been found that after a number of washings, in some fabrics the vertical flame performance deteriorates, but enough that it can fail the vertical flame test; that is, the fabric has a char length in excess of 4 inches. It has been speculated that this may be due to the fabrics becoming more "fluffy" after numerous washings. What is needed, therefore, is to provide a margin of improvement in the thermal performance of fabrics containing polyoxadiazole fibers to offset any such deterioration in vertical flame properties after washings.

SUMMARY OF THE INVENTION

In some embodiments, this invention relates to a flame-resistant spun yarn, woven fabric, and protective garment, comprising a blend of 60 to 85 parts by weight of polyoxadiazole staple fiber and 15 to 40 parts by weight modacrylic staple fiber; based on 100 total parts of the polyoxadiazole staple fiber and modacrylic staple fiber in the yarn. This invention also relates to a flame-resistant garments and apparel such as industrial worker wear, coveralls, shirts, and/or pants made from a fabric containing the flame-resistant yarn.

In some other embodiments, this invention relates to a method of producing a flame-resistant spun yarn comprising the steps of forming a fiber mixture of 60 to 85 parts by weight of polyoxadiazole staple fiber and 15 to 40 parts by weight of modacrylic staple fiber, based on 100 total parts of the polyoxadiazole staple fiber and modacrylic staple fiber in the mixture; and spinning the fiber mixture into a spun staple yarn.

DETAILED DESCRIPTION

The invention relates to a flame-resistant spun staple yarn made from a polyoxadiazole fiber and modacrylic fiber. By "flame resistant" it is meant the spun staple yarn, or fabrics made from the yarn, will not support a flame in air. In preferred embodiments the fabrics have a limiting oxygen index (LOI) of 26 and higher.

For purposes herein, the term "fiber" is defined as a relatively flexible, macroscopically homogeneous body having a high ratio of length to the width of the cross-sectional area perpendicular to that length. The fiber cross section can be any shape, but is typically round. Also, such fibers preferably have a generally solid cross section for adequate strength in textile uses; that is, the fibers preferably are not voided or do not have a large quantity of objectionable voids.

As used herein, the term "staple fibers" refers to fibers that are cut to a desired length or are stretch broken, or fibers that are made having a low ratio of length to the width of the cross-sectional area perpendicular to that length, when compared with filaments. Man made staple fibers are cut or made to a length suitable for processing on cotton, woolen, or worsted yarn spinning equipment. The staple fibers can have (a) substantially uniform length, (b) variable or random length, or (c) subsets of the staple fibers have substantially uniform length and the staple fibers in the other subsets have different lengths, with the staple fibers in the subsets mixed together forming a substantially uniform distribution.

In some embodiments, suitable staple fibers have a cut length of from 1 to 30 centimeters (0.39 to 12 inches). In some embodiments, suitable staple fibers have a length of 2.5 to 20 cm (1 to 8 in). In some preferred embodiments the staple fibers made by short staple processes have a cut length of 6 cm (2.4 in) or less. In some preferred embodiments the staple fibers made by short staple processes have a staple fiber length of 1.9 to 5.7 cm (0.75 to 2.25 in) with the fiber lengths of 3.8 to 5.1 cm (1.5 to 2.0 in) being especially preferred. For long staple, worsted, or woolen system spinning, fibers having a length of up to 16.5 cm (6.5 in) are preferred.

The staple fibers can be made by any process. For example, the staple fibers can be cut from continuous straight fibers using a rotary cutter or a guillotine cutter resulting in straight (i.e., non crimped) staple fiber, or additionally cut from crimped continuous fibers having a saw tooth shaped crimp along the length of the staple fiber, with a crimp (or repeating bend) frequency of preferably no more than 8 crimps per centimeter.

The staple fibers can also be formed by stretch breaking continuous fibers resulting in staple fibers with deformed sections that act as crimps. Stretch broken staple fibers can be made by breaking a tow or a bundle of continuous filaments during a stretch break operation having one or more break zones that are a prescribed distance creating a random variable mass of fibers having an average cut length controlled by break zone adjustment.

Spun staple yarn can be made from staple fibers using traditional long and short staple ring spinning processes that are well known in the art. However, this is not intended to be limiting to ring spinning because the yarns may also be spun using air jet spinning, open end spinning, and many other types of spinning which converts staple fiber into useable yarns. Spun staple yarns can also be made directly by stretch breaking using stretch-broken tow to top staple processes. The staple fibers in the yarns formed by traditional stretch break processes typically have length of up to 18 cm (7 in) long. However spun staple yarns made by stretch breaking can also have staple fibers having maximum lengths of up to around 50 cm (20 in.) through processes as described for example in PCT Patent Application No. WO 0077283.

Stretch broken staple fibers normally do not require crimp because the stretch-breaking process imparts a degree of crimp into the fiber.

The term continuous filament refers to a flexible fiber having relatively small-diameter and whose length is longer than those indicated for staple fibers. Continuous filament fibers and multifilament yarns of continuous filaments can be made by processes well known to those skilled in the art.

The spun staple yarns include a polyoxadiazole staple fiber having a limiting oxygen index (LOI) of 21 or greater, meaning the polyoxadiazole fiber or fabrics made solely from the polyoxadiazole fiber will not support a flame in air. By polyoxadiazole fiber, it is meant fibers comprising polymers comprising oxadiazole units. Processes for making polyoxadiazole polymers and fibers are known in the art; see for example U.S. Pat. No. 4,202,962 to Bach and the Encyclopedia of Polymer Science and Engineering, Vol 12, p. 322-339 (John Wiley & Sons, New York, 1988). In some embodiments the polyoxadiazole fiber contains polyarylene-1,3,4-oxadiazole polymer, polyarylene-1,2,4-oxadiazole polymer, or mixtures thereof. In some preferred embodiments, the polyoxadiazole fiber contains polyparaphenylene-1,3,4-oxadiazole polymer. Suitable polyoxadiazole fibers are known commercially under various tradenames such as Oxalon®, Arselon®, Arselon-C® and Arselon-S® fiber.

The spun staple yarns also include a modacrylic staple fiber. By modacrylic fiber it is meant acrylic synthetic fiber made from a polymer comprising primarily acrylonitrile. Preferably the polymer is a copolymer comprising 30 to 70 weight percent of an acrylonitrile and 70 to 30 weight percent of a halogen-containing vinyl monomer. The halogen-containing vinyl monomer is at least one monomer selected, for example, from vinyl chloride, vinylidene chloride, vinyl bromide, vinylidene bromide, etc. Examples of copolymerizable vinyl monomers are acrylic acid, methacrylic acid, salts or esters of such acids, acrylamide, methylacrylamide, vinyl acetate, etc. The preferred modacrylic fibers used in this invention are copolymers of acrylonitrile combined with vinylidene chloride.

In some embodiments, the copolymer can have, in addition, an antimony oxide or antimony oxides for improved fire retardancy, and such additives are preferably not greater than 25 weight percent of the fiber. Such useful modacrylic fibers include, but are not limited to, fibers disclosed in U.S. Pat. No. 3,193,602 having 2 weight percent antimony trioxide, fibers disclosed in U.S. Pat. No. 3,748,302 made with various antimony oxides that are present in an amount of at least 2 weight percent and preferably not greater than 8 weight percent, and fibers disclosed in U.S. Pat. Nos. 5,208,105 & 5,506,042 having 8 to 40 weight percent of an antimony compound. The preferred modacrylic fiber is commercially available from Kaneka Corporation, Japan, in various forms, some containing no antimony oxides while others such as Protex C® are said to contain 10 to 15 weight percent of those compounds.

In some embodiments the copolymer has in addition either less than 1.5 weight percent antimony oxide or antimony oxides, or the copolymer is totally free of antimony. Such modacrylic fibers can be made by processes that include, but are not limited to, fiber manufacturing processes similar to those that disclose the addition of antimony compounds of a higher percentage during manufacture. In such cases, very low antimony content fibers and antimony-free fibers can be made by restricting the amount of, or eliminating entirely, any antimony compounds added to the copolymer during manufacture.

In some embodiments, the modacrylic staple fiber is a flame resistant char forming fiber with an LOI typically at least 28. In one embodiment the modacrylic fiber has a LOI of at least 28 while also being antimony-free.

In some embodiments, this invention relates to a flame-resistant spun yarn, woven fabric, and protective garment, comprising a blend of 60 to 85 parts by weight of polyoxadiazole staple fiber and 15 to 40 parts by weight modacrylic staple fiber; based on 100 total parts of the polyoxadiazole staple fiber and modacrylic staple fiber in the yarn. In some preferred embodiments the polyoxadiazole staple fiber is present in an amount of 70 to 85 parts by weight, and the modacrylic fiber is present in an amount of 15 to 30 parts by weight, based on 100 total parts of the polyoxadiazole staple fiber and modacrylic staple fiber in the yarn. More than 40 parts by weight modacrylic staple fiber is believed to actually have a deleterious effect on the thermal performance of the yarn and fabric made from the yarn. It is believed the use of modacrylic fiber in the yarn provides increased arc performance to the fabric. The modacrylic fiber is also resistant to the spread of damage to the yarn and fabric due to exposure to flame. However, while the modacrylic fiber is both highly flame resistant and char forming, it is believed that fabrics having too much modacrylic fiber actually have less than the desirable residual strength in the charred fabric.

In some preferred embodiments the various types of staple fibers are present as a staple fiber blend. By fiber blend it is meant the combination of two or more staple fiber types in any manner. Preferably the staple fiber blend is an "intimate blend", meaning the various staple fibers in the blend form a relatively uniform mixture of the fibers. In some embodiments the two or more staple fiber types are blended prior to or while the yarn is being spun so that the various staple fibers are distributed homogeneously in the staple yarn bundle. In some embodiments the yarn is made from an intimate blend consisting essentially of the polyoxadiazole and modacrylic staple fibers. In some preferred embodiments the yarn is made from an intimate blend consisting solely of the polyoxadiazole and modacrylic staple fibers.

Fabrics can be made from the spun staple yarns and can include, but is not limited to, woven or knitted fabrics. General fabric designs and constructions are well known to those skilled in the art. By "woven" fabric is meant a fabric usually formed on a loom by interlacing warp or lengthwise yarns and filling or crosswise yarns with each other to generate any fabric weave, such as plain weave, crowfoot weave, basket weave, satin weave, twill weave, and the like. Plain and twill weaves are believed to be the most common weaves used in the trade and are preferred in many embodiments.

By "knitted" fabric is meant a fabric usually formed by interlooping yarn loops by the use of needles. In many instances, to make a knitted fabric spun staple yarn is fed to a knitting machine which converts the yarn to fabric. If desired, multiple ends or yarns can be supplied to the knitting machine either plied of unplied; that is, a bundle of yarns or a bundle of plied yarns can be co-fed to the knitting machine and knitted into a fabric, or directly into a article of apparel such as a glove, using conventional techniques. In some embodiments it is desirable to add functionality to the knitted fabric by co-feeding one or more other staple or continuous filament yarns with one or more spun staple yarns having the intimate blend of fibers. The tightness of the knit can be adjusted to meet any specific need. A very effective combination of properties for protective apparel has been found in for example, single jersey knit and terry knit patterns.

In some particularly useful embodiments, the spun staple yarns can be used to make flame-resistant garments. In some embodiments the garments can have essentially one layer of the protective fabric made from the spun staple yarn. Garments of this type include jumpsuits, coveralls, pants, shirts, gloves, sleeves and the like that can be worn in situations such as chemical processing industries or industrial or electrical utilities where an extreme thermal event might occur.

In some preferred embodiments the fabrics have a char length when tested per the Vertical Flame Test of 4 inches or less, which is believed to be provided by the increase in measured LOI provided to the polyoxadiazole fiber by the addition of the modacrylic fiber. In some embodiments, the addition of the modacrylic fiber increases the measured LOI by at least 2 percentage points. In some preferred embodiments, the addition of the modacrylic fiber increases the measured LOI by at least 4 percentage points. In some preferred embodiments, the fabrics and garments made from the fabrics have an arc performance at a basis weight of 6 ounces per square yard of greater than 8 calories per square centimeter.

In another embodiment, this invention relates to a method of producing a flame-resistant spun yarn comprising the steps of forming a fiber mixture of 60 to 85 parts by weight of polyoxadiazole staple fiber and 15 to 40 parts by weight of modacrylic staple fiber, based on 100 total parts of the polyoxadiazole staple fiber and modacrylic staple fiber in the mixture; and spinning the fiber mixture into a spun staple yarn.

In some preferred embodiments the polyoxadiazole staple fiber is present in the mixture in an amount of 70 to 85 parts by weight and the modacrylic staple fiber is present in the mixture an amount of 15 to 30 parts by weight, based on 100 total parts of the polyoxadiazole staple fiber and modacrylic staple fiber in the mixture.

In one embodiment the fiber mixture of the polyoxadiazole staple fiber and the modacrylic fiber is formed by making an intimate blend of the fibers. If desired, other staple fibers can be combined in this relatively uniform mixture of staple fibers; however, in some preferred embodiments only the two types of staple fibers are present. The blending can be achieved by any number of ways known in the art, including processes that creel a number of bobbins of continuous filaments and concurrently cut the two or more types of filaments to form a blend of cut staple fibers; or processes that involve opening bales of different staple fibers and then opening and blending the various fibers in openers, blenders, and cards; or processes that form slivers of various staple fibers which are then further processed to form a mixture, such as in a card to form a sliver of a mixture of fibers. Other processes of making an intimate fiber blend are possible as long as the various types of different fibers are relatively uniformly distributed throughout the blend. If yarns are formed from the blend, the yarns have a relatively uniform mixture of the staple fibers also. Generally, in most preferred embodiments the individual staple fibers are opened or separated to a degree that is normal in fiber processing to make a useful fabric, such that fiber knots or slubs and other major defects due to poor opening of the staple fibers are not present in an amount that detract from the final fabric quality.

In a preferred process, the intimate staple fiber blend is made by first mixing together staple fibers obtained from opened bales, along with any other staple fibers, if desired for additional functionality. The fiber blend is then formed into a sliver using a carding machine. A carding machine is commonly used in the fiber industry to separate, align, and deliver fibers into a continuous strand of loosely assembled fibers without substantial twist, commonly known as carded sliver. The carded sliver is processed into drawn sliver, typically by, but not limited to, a two-step drawing process.

Spun staple yarns are then formed from the drawn sliver using techniques including conventional cotton system or short-staple spinning processes such as open-end spinning and ring-spinning; or higher speed air spinning techniques such as Murata air-jet spinning where air is used to twist the staple fibers into a yarn. The formation of spun yarns can also be achieved by use of conventional woolen system or long-staple processes such as worsted or semi-worsted ring-spinning or stretch-break spinning. Regardless of the processing system, ring-spinning is the generally preferred method for making the spun staple yarns.

Test Methods

Basis weight values were obtained according to FTMS 191A; 5041.

Instrumented Thermal Manikin Test. Burn protection performance is determined using "Predicted Burn Injuries for a Person Wearing a Specific Garment or System in a Simulated Flash Fire of Specific Intensity" in accordance with ASTM F 1930 Method (1999) using an instrumented thermal mannequin with standard pattern coverall made with the test fabric.

Arc Rating Test. The arc resistance of fabrics is determined in accordance with ASTM F-1959-99 "Standard Test Method for Determining the Arc Thermal Performance Value of Materials for Clothing".

Grab Test. The grab resistance of fabrics (the break tensile strength) is determined in accordance with ASTM D-5034-95 "Standard Test Method for Breaking Strength and Elongation of Fabrics (Grab Test)".

Trap Tear Test. The tear resistance of fabrics is determined in accordance with ASTM D-5587-03 "Standard Test Method for Tearing of Fabrics by Trapezoid Procedure".

Vertical Flame Test. The char length of fabrics is determined in accordance with ASTM D-6413-99 "Standard Test Method for Flame Resistance of Textiles (Vertical Method)".

Limiting Oxygen Index (LOI) is the minimum concentration of oxygen, expressed as a volume percent, in a mixture of oxygen and nitrogen that will just support the flaming combustion of a material initially at room temperature under the conditions of ASTM G125/D2863.

EXAMPLES

The invention is illustrated by, but is not intended to be limited by, the following examples:

Example 1

This example illustrates flame-resistant spun yarns and fabrics of intimate blends of the polyoxadiazole (POD) staple fiber and a modacrylic (MOD) staple fiber.

A picker blend sliver of 85 weight percent of POD staple fiber and 15 weight percent of modacrylic staple fiber is prepared and is processed by conventional cotton system equipment and then spun into a flame resistant spun staple yarn having a twist multiplier of about 4.0 and a single yarn size of about 19.6 tex (30 cotton count) using a ring spinning frame. Two such single yarns are then plied on a plying machine to make a two-ply flame resistant yarn for use as a fabric warp yarn and fill yarn.

The ring-spun warp and fill yarns are woven into a fabric on a shuttle loom, making a greige fabric having a 2×1 twill weave and a construction of 25 ends×15 picks per cm (70 ends×42 picks per inch), and a basis weight of about 186 g/m$^2$ (5.5 oz/yd$^2$). The greige twill fabric is then scoured in hot water and is dried under low tension. The scoured fabric is then jet dyed using basic dye. The resulting fabric has a basis weight of about 203 g/m$^2$ (6 oz/yd$^2$) and an LOI in excess of 25.

A portion of the fabric is cut into various shapes and the shapes are sewn together to convert the fabric into single-layer protective garments useful for those exposed to fire and arc hazards. In a similar manner, ring-spun yarns, and the associated fabric and garment are made from 100% POD staple fiber as a control. Table 1 illustrates the properties of the resulting fabric and garments. A "+" rating indicates superior properties to those of the control, the notation "0" indicates the performance of the control or performance equivalent to the control, and the notation "–" indicates the performance of the control is better. The fabric of Example 1 has both improved vertical flame performance and improved arc rating, while maintaining adequate performance in the instrumented thermal manikin test.

Example 2

Example 1 is repeated with the blends of fibers being 70 weight percent of POD fiber and 30 weight percent of modacrylic fiber. Table 1 illustrates the properties of the resulting fabric and garments. It is believed that due to the higher content of modacrylic fiber in the yarn, the fabric of Example 2 has both improved vertical flame performance and also a superior arc rating that compensates for the performance of the fabric in the instrumented thermal manikin test.

Comparison Example A

Example 1 is repeated with the blends of fibers being 55 weight percent of POD fiber and 45 weight percent of modacrylic fiber. Table 1 illustrates the properties of the resulting fabric and garments. While this blend has comparable vertical flame performance and superior arc rating to the control fabric, it is considered to have too much modacrylic fiber for adequate performance in the instrumented thermal manikin test.

Comparison Example B

Example 1 is repeated with the blends of fibers being 45 weight percent of POD fiber and 55 weight percent of modacrylic fiber. Table 1 illustrates the properties of the resulting fabric and garments. While this blend has comparable vertical flame performance and superior arc rating to the control fabric, it is considered to have too much modacrylic fiber for adequate performance in the instrumented thermal manikin test. Table 1

What is claimed is:

1. A yarn useful in flame protection comprising a blend of:

a) 60 to 85 parts by weight of polyoxadiazole staple fiber; and b) 15 to 40 parts by weight modacrylic staple fiber; based on 100 total parts of the polyoxadiazole staple fiber and modacrylic staple fiber in the yarn.

2. The yarn of claim 1, wherein the blend comprises:

a) 70 to 85 parts by weight of polyoxadiazole staple fiber; and b) 15 to 30 parts by weight modacrylic staple fiber; based on 100 total parts of the polyoxadiazole staple fiber and modacrylic staple fiber in the yarn.

3. The yarn of claim 1 wherein the polyoxadiazole staple fiber comprises polyarylene-1,3,4-oxadiazole, polyarylene-1,2,4-oxadiazole, or mixtures thereof.

4. The yarn of claim 2 wherein the polyoxadiazole staple fiber comprises polyarylene-1,3,4-oxadiazole, polyarylene-1,2,4-oxadiazole, or mixtures thereof.

5. The yarn of claim 1 wherein the polyoxadiazole staple fiber comprises polyparaphenylene-1,3,4-oxadiazole.

6. The yarn of claim 2 wherein the polyoxadiazole staple fiber comprises polyparaphenylene-1,3,4-oxadiazole.

7. A woven fabric comprising the yarn of claim 1.

8. A woven fabric comprising the yarn of claim 2.

9. A protective garment comprising the yarn of claim 1.

10. A protective garment comprising the yarn of claim 2.

11. A method of producing a flame resistant spun yarn comprising:

a) forming a fiber mixture of 60 to 85 parts by weight of polyoxadiazole staple fiber and 15 to 40 parts by weight of modacrylic staple fiber, based on 100 total parts of the polyoxadiazole staple fiber and modacrylic staple fiber in the mixture; and b) spinning the fiber mixture into a spun staple yarn.

12. The method of producing a flame resistant spun yarn of claim 11 wherein the fiber mixture comprises of 70 to 85 parts by weight of polyoxadiazole staple fiber and 15 to 30 parts by weight of modacrylic staple fiber, based on 100 total parts of the polyoxadiazole staple fiber and modacrylic staple fiber in the yarn.

13. The method of producing a flame resistant spun yarn of claim 11 wherein the polyoxadiazole staple fiber comprises polyarylene-1,3,4-oxadiazole, polyarylene-1,2,4-oxadiazole, or mixtures thereof.

14. The method of producing a flame resistant spun yarn of claim 12 wherein the polyoxadiazole staple fiber comprises polyarylene-1,3,4-oxadiazole, polyarylene-1,2,4-oxadiazole, or mixtures thereof.

* * * * *

| Property | Control | Example 1 | Example 2 | Example A | Example B |
|---|---|---|---|---|---|
| Composition | 100% POD | 85% POD/ 15% MOD | 70% POD/ 30% MOD | 55% POD/ 45% MOD | 45% POD/ 55% MOD |
| Grab Test Break Strength (lbf) W/F | 0 | + | + | + | + |
| Trap Tear (lbf) W/F | 0 | + | + | + | + |
| LOI (%) | 0 | + | + | + | + |
| Vertical Flame (in) W/F | 0 | + | + | 0 | 0 |
| Instrumented Thermal Manikin Test (% of body burn) | 0 | 0 | – | –– | –– |
| ARC rating(cal/cm$^2$) | 0 | + | ++ | ++ | ++ |